US007509084B2

(12) United States Patent
Gervasi et al.

(10) Patent No.: US 7,509,084 B2
(45) Date of Patent: Mar. 24, 2009

(54) ELECTROPHOTOGRAPHIC MARKING SYSTEMS WITH RELEASE AGENTS

(75) Inventors: David J. Gervasi, Webster, NY (US); Santokh S. Badesha, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 500 days.

(21) Appl. No.: 11/455,612

(22) Filed: Jun. 19, 2006

(65) Prior Publication Data

US 2008/0124142 A1 May 29, 2008

(51) Int. Cl.
*G03G 15/20* (2006.01)

(52) U.S. Cl. ..... 399/324; 399/328; 430/124.1; 430/124.21; 430/124.3

(58) Field of Classification Search ..... 399/324, 399/328; 430/124.1, 124.21, 124.3
See application file for complete search history.

(56) References Cited

U.S. PATENT DOCUMENTS 3,253,932 A * 5/1966 White et al. ..... 106/38.22
3,577,501 A * 5/1971 York ..... 264/213

OTHER PUBLICATIONS

Abstract of Japanese Patent No. 09001309 A, Jan. 7, 1997.*

* cited by examiner

*Primary Examiner*—Hoa V Le
(74) *Attorney, Agent, or Firm*—James J. Ralabate

(57) ABSTRACT

This is an electrophotographic marking system with the ability to minimize adherence of a marking composition to a fixing component in the system, such as a fuser roll. In this manner, offset is avoided and a better image results on the paper or receiving medium. This is accomplished by using a substituted polyolefin as a release agent that is coated on the surface of the fuser roll.

20 Claims, 2 Drawing Sheets

ELECTROPHOTOGRAPHIC MARKING SYSTEMS WITH RELEASE AGENTS

This invention relates to marking systems and, more specifically, to electrophotographic marking subsystems with provisions therein for use of improved release agents.

CROSS REFERENCES

A related invention is disclosed and claimed in a co-pending application ID 20060003Q owned by the same assignee as the present case. This co-pending application discloses and claims the use of materials including hydrocarbons of poly-alpha olefene for release agents directly replacing silicon release agents presently used in ink jet printing systems. The present application ID 20060003 and above application ID 20060003Q are filed concurrently herewith. The disclosure of ID 20060003Q is incorporated herein by reference.

BACKGROUND

Electrophotographic image-forming machines are used to transfer images onto paper or other medium in both printing and copier systems. Generally, a photoconductor is selectively charged and optically exposed to form an electrostatic latent image on the photoconductor surface. Toner is deposited onto the charged photoconductor surface. The toner has a charge; thus, it will adhere to the photoconductor surface in areas corresponding to the electrostatic latent image. The toner image is transferred to the paper or other medium. The toned paper is heated by any of several methods including a fuser roller system and the toner in image-wise configuration is fused to the paper. The photoconductor is then refreshed—cleaned to remove any residual toner and charge—to make it ready for another image. The imaged paper is then passed to a document output collection area or tray where the user collects the finished, permanently imaged paper or documents.

The fuser roll used in the fuser roller system eventually becomes contaminated with a film or debris containing toner or by-products of toner and paper. This contamination usually takes the form of a film which eventually builds up and adversely affects the performance and life of the fuser roll.

This fuser roll contamination can generally occur in any fuser system of an electrophotographic printer or copier, and it causes marks on copy (MOC) in addition to marks caused by prior image history. Generally, the fuser roll becomes contaminated, as earlier noted, with toner and by-products of fuser chemical reactions which eventually can cause early failure of the entire fusing system.

Problems with toner debris on the fuser roller can eventually affect the pressure roll and also the quality and clarity of the imaged paper in contact with the fuser roller. As noted above, the life of the fuser roll can be substantially shortened if this contamination problem is not properly addressed. This results in increasing customer operating costs.

It is desired in the fusing process that minimal or no offset of the toner particles from the support to the fuser member takes place during normal operations. Toner particles offset onto the fuser member can subsequently transfer to other parts of the machine or onto the support in subsequent copying cycles, thereby increasing the image background, causing inadequate copy quality, causing inferior marks on the copy, or otherwise interfering with the material being copied there as well as causing toner contamination of other parts of the machine. The defect referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release properties of the fuser member, and accordingly it is desirable to provide a fusing surface having a low surface energy to provide the necessary release.

The use of polymeric release agents having functional groups which interact with a fuser member to form a thermally stable, renewable self-cleaning layer having good release properties for electroscopic thermoplastic resin toners, is described in, for example, U.S. Pat. Nos. 4,029,827, 4,101,686, and 4,185,140, the disclosures of each of which are totally incorporated herein by reference.

In color or monochrome xerographic marking fusing systems and subsystems, silicone fluids are presently predominantly used as release agents. There are many associated defects and failure modes associated with the use of these fluids, especially when they are employed in machines printing full colors and requiring longer service life. Silicone is by nature chemically and physically susceptible to reaction with many other species in the environment, such as toner and toner additives, ink components, paper debris, etc. Side reactions with these species can lead to premature gelation, toner offset, slime, image defects, which ultimately lead to shortened component and subsystem operation life. This life shortfall directly impacts operation costs incurred by both manufacturers and customers. End use applications in particular, are negatively impacted by the use of amine-functional silicone fluids, as the amine functionality interacts with the surface of both coated and un-coated paper stocks. This leaves a persistent film on the surface that inhibits adhesives, UV overcoats write-ability, post-it notes use, book binding, and other end use elements from properly functioning.

SUMMARY

The present embodiments provide the use of hydrocarbon or poly-alpha olefin (PAO) based fluids for release agent applications, directly replaces the use of silicone fluids. Hydrocarbon fluids can be manufactured for improved thermal stability and can be modified to include functional side chains for enhanced performance with specific surfaces. A primary advantage of hydrocarbon fluids over silicone related to end use applications is the improved diffusion into paper bulk more readily than amine functional silicones. Specially modified hydrocarbon based fluids also have been shown to work effectively in monochrome xerographic fusing applications, and their use in color printing applications are effective as well.

The silicon fluid is normally functionalized with either amino functional, fluoro-functional or mercapato functional side chains in order to facilitate wettability and surface coverage of fuser and transfix components. Silicone oil is by nature thermally and chemically stable. However, the harsh environment of xerographic fuser cavities can lead to thermal and chemical degradation and side reaction with toner and toner components. Silicone oil is also quite interactive physically and chemically with these toner components. In addition, an issue that arises more frequently in color printing applications utilizing amine-functional silicone fluid is the inhibition of end use application for color prints.

The primary behavior that negatively impacts end use applications is silicone oil diffusion into the bulk of paper. When the release agent layer splitting occurs at the fuser roll surface, oil is transferred to the paper, coating the surface of the paper. Ideally, the release agent would diffuse into the paper before the adhesive was or other end use applications steps took place. However, amine-functional silicone oil adheres to the surface of both coated and uncoated paper. This limits the overall diffusion of silicone oil into the bulk of the paper, and negatively impacts inline end use processing by way of the silicone oil interfering with adhesives and components of other end-use applications, such as overcoat varnishes and bookbinding materials.

The use of hydrocarbon fluids offers an alternate release fluid that does not cause wetting and adhesion issues on the surface of prints as does the amine-functional silicone oil. The hydrocarbon fluids should diffuse more readily into paper, reducing the amount of oil on the paper surface after fusing. In addition, hydrocarbon fluids are not as repellant to end use materials as silicone oil, so the inhibition that occurs with silicone oil will not occur with hydrocarbon fluids should some release agent remain on the paper surface.

This invention provides the use of hydrocarbon or poly-alpha olefin (PAO) based fluids for release layer applications directly replacing silicone release agents or fluids. Hydrocarbon fluids similar to silicone fluids can be modified to provide functional interaction with select release surface materials. Benefits of hydrocarbon fluids over silicone fluids include improved diffusion into paper bulk, lower cost, fewer end use dysfunctions and less negative interaction with other species in the environment. Specifically, fluid cost would be much less than that of typical silicone release agents. The PAO fluids will not cause wetting and will more readily diffuse into the bulk of the paper thereby minimizing end use application issues such as inadequate adhesion for book binding and/or overcoat varnishing. In testing, the hydrocarbon fluid demonstrated release life comparable to that of nominal functional silicone fluids at nominal application rates. This fluid is a viable candidate for use in mono/color xerographic printers as well as solid ink jet products. Bench experiments demonstrate PAO surface wetting & contact angle measurements on standard Viton and silicone slabs to be similar to that of silicone oils, suggesting comparable surface coverage and perhaps overall release. It is believed that unpublished experimental testing conducted at Torrey Pines Research and Exxon Mobile has demonstrated that PAO hydrocarbon fluids can be used effectively in monochrome xerographic fusing applications (Docutech). It is understood that extended life testing did not take place but experimental feasibility in monochrome xerographic fusing has been demonstrated.

The fusing subsystem of an embodiment of this invention will be described in relationship to an electrostatic marking system; however, it can be used in any marking system where a release agent is used to prevent adherence of the marking materials to the fixing or fusing component(s). The present subsystem useful is a marking system comprises in an operative arrangement, image marking and fixing component(s), a source of marking material and a source of a release agent. The release agent is enabled to minimize adherence of the marking material to the fixing component(s). The release agent used is a substituted polyolefin. The release agent-fluid is a single poly-alpha olefin (PAO) component or blend of the following polyolefin materials with the general formulas:

A: $CH_3—(CH_2)_m—CHR_1—(CH_2)_n—CH_3$ where $R_1$ is an amine, mercapto, ester, hydroxyl, fluoroalkyl or carboxylic acid functional group of $C_4$-$C_{20}$. m+n=20–720 and m=0–720 and n=0–720

B: $R_1—(CH_2)_p—R_2$ p=20–720, $R_1$ is same as A. above and $R_2$=$R_1$ or $CH_3$.

C: $CH_3—(CH_2)_m—CHR_3—(CH_2)_n—CH_3$ where R3 is $—(CH_2)_q—R_1$ where q=1–200.

D: $CH_3—(CH_2)_p—CH_3$

The basic structure for the materials of the release agents of this invention is a backbone of polyethylene, synthesized as linear compounds to make a fluid with a range of viscosity of: For solid ink jet applications, 5-300 cP, preferably 10-100 cP; for the present Xerographic fusing applications, either 300-100 cP, preferably 500-700 cP (color applications) or 500-5000 cP, preferably 1000-2000 cP. The release fluid should be comprised of two components. The first component should be a poly-alpha olefin (hydrocarbon) containing a functional chemical group that promotes wetting and adhesion of the bulk fluid to the intended substrate material. The second component should be a poly-alpha olefin (hydrocarbon) containing no special or additional chemical groups. The primary function of the second component is to dilute the viscosity and functional group concentration to a desired level for the specific application.

In one embodiment of an electrostatic solid monochrome marking system, the liquid polyolefin release agent is provided in a release agent reservoir with a meter roll adapted to transfer the release agent to a donor roll and subsequently to the fuser roll. As the toned paper or receiving number passes between the fuser roll and the pressure roll, the release agent provides that the toner stick to the paper and not to the fuser roll (toner offset). The fuser roll is maintained substantially free of toner, and the quality of the final paper copy is substantially enhanced. In another embodiment such as a mono or color ink jet system, the release agent is applied first to the imaged drums, then the toner image is transferred to a paper receiving number and fixed by a multi-layer elastomer transfix roll.

Generally in a color system about 5-12 milligrams of release agent is applied per page of receiving member, in a mono system from 0.5-5 milligrams are applied per page, and in a direct marking system like ink jet from a bout 1-7.0 milligrams are applied per 8½" by 11" page of receiving member. As noted earlier, the release agent of this invention can be used in any suitable marking system where a release agent is required to remove toner or marking material from a fixing means such as a fuser or transfix roll. Specifically, in a xerographic or electrostatic system the release agent is applied to the fuser roll prior to contact of the fuser roll with the paper or receiving number.

For clarity purposes, the embodiments of this invention will be described with reference to an electrophotographic system.

DETAILED DISCUSSION OF THE DRAWINGS AND PREFERRED EMBODIMENTS

Figure 1:
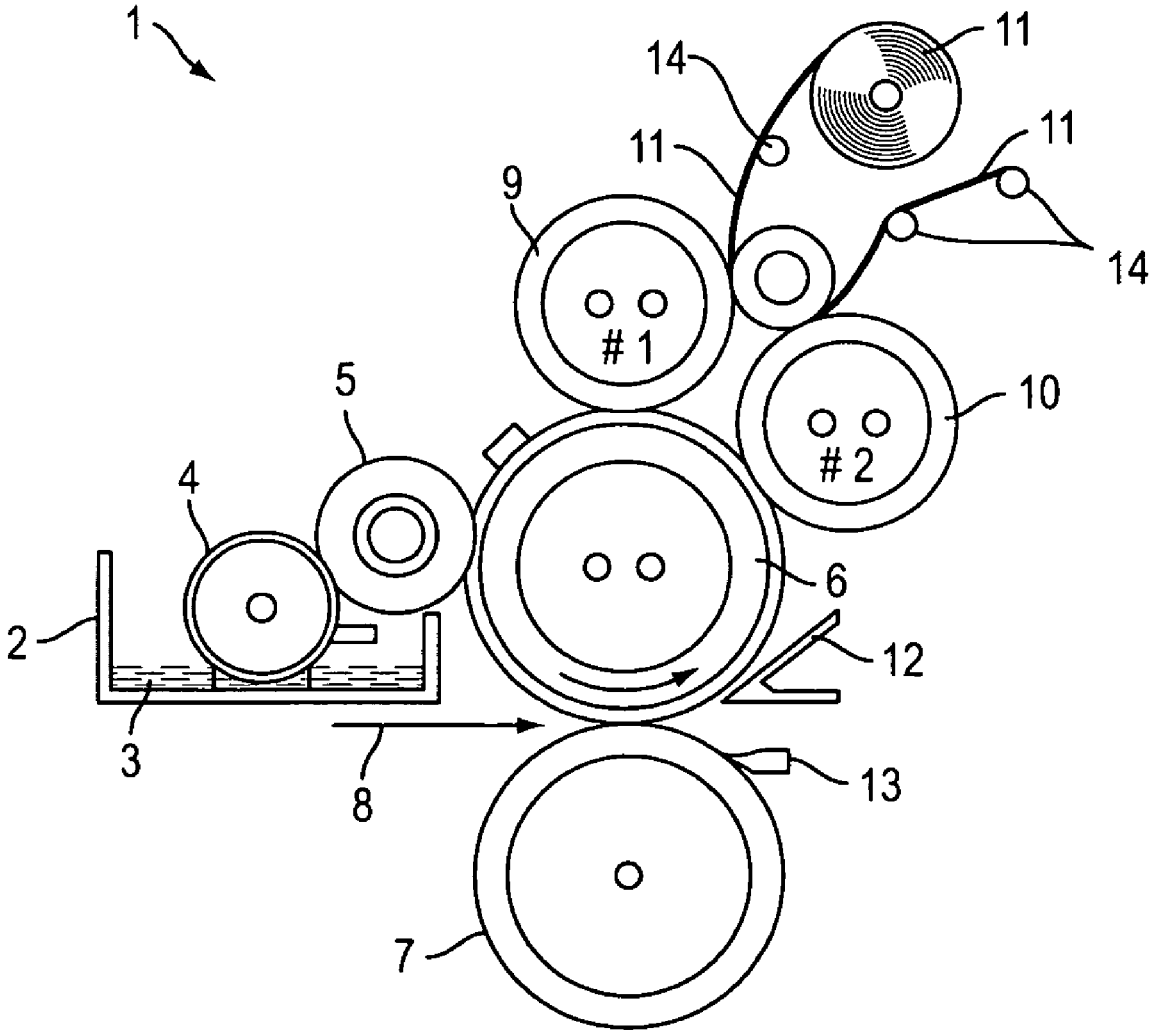
FIG. 1 is a typical side elevational view of a xerographic or electrostatic marking system using the present release agent.

In FIG. 1 an electrophotographic marking-fusing subsystem is illustrated having a release agent reservoir or sump 2. In the reservoir 2 in contact with the polyolefin release agent 3 of this invention is a metering roll 4. The metering roll 4 transports the release agent 3 from reservoir 4 to a donor roll 5. The donor roll 5 applies a suitably thin uniform layer of release agent 3 to the fuser roll 6 surface. The fuser roll 6 is in moving contact with a pressure roll 7 through which a final paper or media sheet 8 is fed. Heating and cleaning rolls 9 and 10 heat the fuser roll 6 to a temperature of about 365° F. A cleaning web 11 is in movable contact with heating rolls 9 and 10 to clean their surfaces. Pulley rolls 14 help move web 11 in contact with heating rolls 9 and 10. An air knife 12 and stripper finger 13 direct the final paper copy 8 to a collection tray. The image permanence on paper 8 is obtained via heat and pressure. The fuser roll 6 is heated to about 150-200 C, the heat rolls 9 and 10 to 220 C and the pressure reaches about 100 psi.

Figure 2:
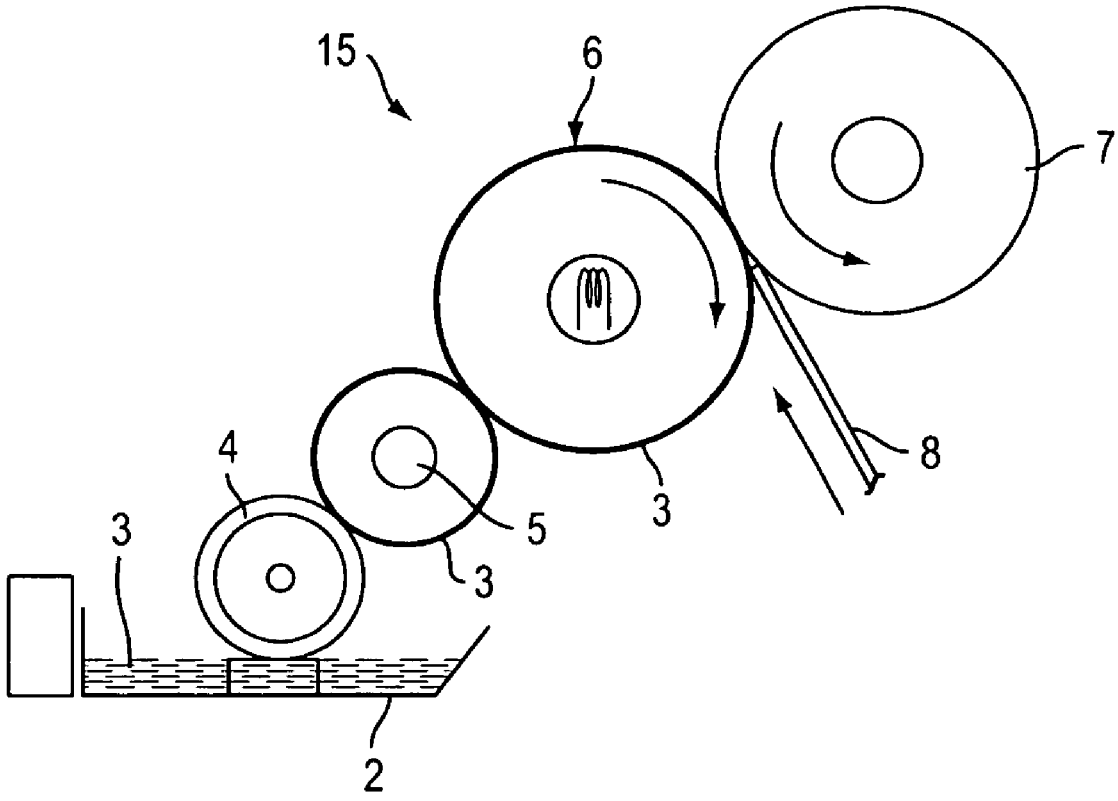
FIG. 2 is a typical fusing subsystem used in the system of FIG. 1.

In FIG. 2 an embodiment of this invention's fusing subsystem 15 is illustrated. In this embodiment a monochrome-solid toner fusing system 15 is used. The paper or other copy sheet 8 is shown traveling between fuser roll 6 and pressure roll 7. A thin release agent 3 coating of about 1000 nm is applied to fuser roll surface 6 by donor roll 5. The meter roll 4 supplies release agent 3 to the donor roll 5. A sump or release agent reservoir 2 holds the polyolefin release agent 3 of this invention for distribution to the meter roll 4, donor roll 5 and fuser roll 6. The release agent 3 of this invention must have mark release capability, must have chemical stability to toners, oils, inks and substrates.

The release agent of this invention must be thermally stable and have the required thermal conductivity. It should be dimensional stable (non-swelling) and conform to soft roll copy quality. It must also have physical properties of wear resistance and release properties. There must be chemical stability of the coolings and the release agent of this invention. All of these qualities ensure that the toner used will stick to the paper and not to the fuser roll (toner offset).

The polyolefin release agent of this invention, as above noted, can be used in any marking system requiring maximum mark transfer to paper or receiving medium and maximum retention on a mark fixing component, such as a fuser roll.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A fusing subsystem useful in an electrophotographic marking system, comprising in an operative arrangement image marking and fixing component(s), a source of marking material and a source of a release agent, said release agent enabled to minimize adherence of said marking material to said fixing component, said release agent being a substituted polyolefin solution comprising a single poly-alpha olefin or a blend of polyolefin materials with the following general formulas:

A: $CH_3—(CH_2)_m—CHR_1—(CH_2)_n—CH_3$ where $R_1$ is selected from the group consisting of an amine, mercapto, ester, hydroxyl, fluoroalkyl or carboxylic acid functional group of $C_4—C_{20}$ and m=0–720 and n=0–720, however, at least 1 m or 1 n is present and m+n=20–720;

B: $R_1—(CH_2)_p—R_2$ p=20–720, $R_1$ is same as A, above and $R_2$=$R_1$ or $CH_3$;

C: $CH_3—(CH_2)_m—CHR_3—(CH_2)_n—CH_3$ where $R_3$ is $—(CH_2)_q—R_1$ where q=1–200;

D: $CH_3—(CH_2)_p—CH_3$.

2. The subsystem of claim 1 wherein the polyolefin has a viscosity of at least 10 cP.

3. The subsystem of claim 1 wherein the polyolefin has volatile matter of less than 10%.

4. The subsystem of claim 1 wherein the polyolefin has a viscosity of from about 10 to about 1000 cP and volatile matter of from about 0 to about 10% by weight.

5. A marking system comprising in an operative arrangement image marking and fixing components, a source of marking material and a source of a release agent, said release agent enabled to minimize image offset and adherence of said marking material to said image marking and fixing components, including a fuser in said system, said release agent being a substituted polyolefin, said polyolefin release agent-fluid being a single component or blend of polyolefin materials with the following general formulas:

A: $CH_3—(CH_2)_m—CHR_1—(CH_2)_n—CH_3$ where $R_1$ is selected from the group consisting of an amine, mercapto, ester, hydroxyl, fluoroalkyl or carboxylic acid functional group of $C_4—C_{20}$ and m=0–720 and n=0–720, however, at least 1 m or 1 n is present and m+n=20–720;

B: $R_1—(CH_2)_p—R_2$ p=20–720, $R_1$ is same as A, above and $R_2$=$R_1$ or $CH_3$;

C: $CH_3—(CH_2)_m—CHR_3—(CH_2)_n—CH_3$ where $R_3$ is $—(CH_2)_q—R_1$ where q=1–200;

D: $CH_3—(CH_2)_p—CH_3$

Said release agent enabled to increase diffusion and marking material to a receiving medium such as paper.

6. The system of claim 5 wherein the polyolefin has a viscosity of at least 10 cP.

7. The system of claim 5 wherein the polyolefin has volatile matter of less than 10% of said fluid.

8. The system of claim 5 wherein said release agent is applied to said fixing components prior to fixing said image on a receiving medium.

9. An electrophotographic marking system comprising in an operative arrangement a movable photoconductive surface, a marking material, a heated fuser roll, a pressure roll, a transport enabled to move a mark receiving medium or paper through said system, a release agent reservoir containing a release agent, and a release agent supplied within said reservoir, said reservoir enabled to dispense a thin release agent coating of at least 1,000 mm on said fuser roll, said release agent being a substituted polyolefin having a general formula of claim 1, said polyolefin having a viscosity of at least 10 cP and volatile matter of about 0-10% by weight, said release agent adapted to minimize adherence of said marking material to said fuser roll prior to said paper passing through a nip formed between said fuser roll and said pressure roll during a mark fixing step.

10. The system of claim 9 wherein monochrome marking system components are used.

11. The system of claim 9 wherein color marking system components are used.

12. The system of claim 9 wherein said marking material is selected from the group consisting of solid marking material, liquid marking material and mixtures thereof.

13. The system of claim 9 comprising an electrostatic reproducing apparatus comprising in an operation arrangement, a photoreceptive surface, a liquid or solid toner dispenser, a fuser roll, a pressure roll, and a release agent dispenser, said release agent being a poly-alpha olefin (PAO).

14. The system of claim 9 having an electrophotographic apparatus wherein said fixing components comprise a heated fuser roll in movable contact with a pressure roll, said source of a release agent enabled to deposit a thin poly-alpha olefin release agent film upon said fuser roll, said apparatus adapted to subsequently move an imaged substrate between said fuser roll and said pressure roll.

15. The system of claim 9 wherein said release agent is enabled to provide improved diffusion of said marking material into a paper receiving member.

16. The system of claim 9 wherein the marking material is a member selected from the group consisting of solid toner, liquid marking material, and mixtures thereof and wherein said release agent is a member selected from the group consisting of substituted poly olefins, unsubstituted polyolefins and mixtures thereof.

17. The system of claim 9 wherein said polyolefin has a viscosity of at least 10 cP.

18. The system of claim 9 wherein said release agent is a poly-alpha olefin having selected functional side chains adapted for use with selected appropriate different photoconductive surfaces.

19. The system of claim 9 wherein suitable functional side chains are provided to enhance the thermal stability of said polyolefin release agents.

20. The system of claim 9 wherein said release agent is enabled to reduce wetting and adhesion of said marking material on the surface of said receiving medium.

* * * * *